US005581844A

United States Patent [19]

Raheb et al.

[11] Patent Number: 5,581,844

[45] Date of Patent: Dec. 10, 1996

[54] DOORSTOP

[76] Inventors: Robert Raheb, 311 Silver Lagoon Dr., Toms River, N.J. 08753; Walter Raheb, 1900 Horatio Ave., Merrick, N.Y. 11566

[21] Appl. No.: 506,327

[22] Filed: Jul. 24, 1995

[51] Int. Cl.[6] ..... E05F 5/00

[52] U.S. Cl. ..... 16/82; 16/86 A; 16/DIG. 14; 292/DIG. 65

[58] Field of Search ..... 16/82, 86 R, 86 A, 16/223, 320, 86 B, 83, DIG. 14; 292/251.5, 288, DIG. 65, DIG. 19

[56] References Cited

U.S. PATENT DOCUMENTS

| | | | |
|---|---|---|---|
| 83,967 | 11/1868 | Horrell | 292/288 |
| 1,616,265 | 2/1927 | Kroehling | 292/288 |
| 1,884,506 | 10/1932 | Atwood | 16/86 R |
| 2,659,116 | 11/1953 | Korb | 292/251.5 |
| 2,861,831 | 11/1958 | Loeb | 292/251.5 |
| 2,889,571 | 6/1959 | Moore | 16/82 |
| 3,079,535 | 2/1963 | Schultz | 292/251.5 |
| 4,183,593 | 1/1980 | Peterson | 16/DIG. 14 |
| 4,648,152 | 3/1987 | Grewall | 16/82 |

*Primary Examiner*—M. Rachuba
*Assistant Examiner*—Donald M. Gurley
*Attorney, Agent, or Firm*—Michael I. Kroll

[57] ABSTRACT

An improved doorstop comprising a block member. A structure is for securing in a removable manner the block member against a leaf of a hinge on a doorjamb, so as to stop a door from closing completely into the doorjamb and preventing fingers of a hand of a person getting caught and damaged between an edge of the door and the doorjamb.

6 Claims, 2 Drawing Sheets

DOORSTOP

BACKGROUND OF THE INVENTION

1. Field of the Invention

The instant invention relates generally to door closure preventing devices and more specifically it relates to an improved doorstop.

2. Description of the Prior Art

Numerous door closure preventing devices have been provided in prior art. For example, U.S. Pat. Nos. 3,488,667 to Gutshall; 3,602,942 to Neff, Sr. et al.; 3,913,171 to Reid; 4,462,623 to Grant; 4,738,002 to Shank and 5,291,631 to Schjoneman all are illustrative of such prior art. While these units may be suitable for the particular purpose to which they address, they would not be as suitable for the purposes of the present invention as heretofore described.

GUTSHALL, CHARLES E.

DOOR HINGE AND STOP DEVICE

U.S. Pat. No. 3,488,667

There is disclosed a device for hingedly connecting a door to a cabinet such as a washing machine cabinet for permitting movement of the door between an open and closed position. The device comprises a bushing or grommet having a non-circular bore through a shank defined by resilient and expandable walls. The grommet is adapted to be mounted in an aperture in the cabinet. Another grommet or bushing is mounted in the door for movement therewith. A pin is connected with the second grommet and has a non-circular shank projecting into the first grommet. The construction is such that upon movement of the door from the closed position, corners of the non-circular pin engage and expand the walls of the non-circular shank which then spring back when the door is opened a predetermined amount, for example ninety degrees, and resiliently lock the door in the open position.

NEFF, SR., EDSEL B. MILLER, LINTON L.

DOOR HINGE STOP

U.S. Pat. No. 3,602,942

A readily applicable and removable self-contained butt hinge attachment which serves as a limit stop, that is, functions to check the angular spreading movement of the knuckle-equipped leaves. It comprises a C-shaped resilient clip conformingly slipped into place over either one (top or bottom) of the pintie-accommodating knuckles. The bight portion of the clip is formed with a projecting riblike stop shoulder. The spaced edges diametrically opposite the stop shoulder have flat liplike outstanding flanges which straddle and yieldingly contact the leaf which is sandwiched therebetween. An optional split spring-biased ring encircles the pintle and has stabilizing fingers embracing the respective flanges.

REID, ERNEST A.

DOOR HINGE PIN MOUNTED ADJUSTABLE DOORSTOP

U.S. Pat. No. 3,913,171

A pair of abutment arms are provided including first and second pairs of corresponding ends. The first pair of corresponding ends are provided with resilient members. The second pair of corresponding ends include transverse splined sleeve and shank portions which are removably axially slideably engageable with each other in predetermined adjusted relative angular positions of the arms. The doorstop further includes a hinge pin extending axially of and supported from one of the second pair of corresponding ends of the arms for telescopic reception within the series of axially aligned interdigitated hinge barrels provided on conventional hinges. With the abutment-equipped arms thus mounted relative to the hinge barrels of a hinge, one of the abutment-equipped first pair of ends of the arms may be positioned to engage an adjacent wall surface. The other abutment-equipped arm end of the fist pair of corresponding arm ends may be positioned to engage the associated door to limit opening of the latter relative to the aforementioned wall surface.

GRANT, CRAIG A.

SAFETY DOOR STOPPER

U.S. Pat. No. 4,462,623

A foot operated door stop adapted to be positioned in a floor opening adjacent the door, so as to effectively limit its degree of opening as a safety and anti-burglar means. This door stopper is in the form of inner and outer telescopically mounted cylindrical members. The inner cylinder is spring urged to an extended position wherein such member projects upwardly from the floor in a door blocking position. The inner member is guided by specific means at the upper and lower ends of the outer member. A particular detent assembly is mounted in such inner member, so as to present the means by which the inner member may be held in its retracted or non-operative position. The inner cylinder is also adapted to freely rotate with respect to the outer cylinder.

SHANK, JOSEPH M.

HINGE MOUNTED DOORCHECK

U.S. Pat. No. 4,738,002

Hinge mounted doorstops which include channel members having a normally horizontal perforated web and normally vertical opposed flanges on opposite sides of the web mounted on top of door hinge hubs, engaged by the top hinge pin. Edges of the flanges engage the hinge leaves to limit a door opening past a predetermined arcuate amount. The hinge mounted doorstops permitting opening of doors in the general arcuate range of ninety degrees to one hundred and eighty degrees.

SCHJONEMAN, CRAIG A.

DOOR STOP

U.S. Pat. No. 5,291,631

A flexible, rubber-like member in the shape of a flat "dumpbell" has a pair of holes at either enlarged end thereof for fitment respectively about the opposed knobs or handles of a door with the narrow portion thereof wrapping around the side edge of the door proximal the knobs to prevent closure of the door. In an alternatively preferred embodiment, there is provided a signal generating mechanism for indicating when an attempt is being made to close the door with which it is being used.

SUMMARY OF THE INVENTION

A primary object of the present invention is to provide an improved doorstop that will overcome the shortcomings of the prior art devices.

Another object is to provide an improved doorstop that can be magnetically clamped onto a door jamb leaf of a hinge on a door, to obstruct the door from closing totally into the doorjamb.

An additional object is to provide an improved doorstop that will protect the fingers of a child from either edge of a closing door, particularly at the hinge edge of the door where there is more pounds of pressure per square inch.

A further object is to provide an improved doorstop that is simple and easy to use.

A still further object is to provide an improved doorstop that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

Various other objects, features and attendant advantages of the present invention will become more fully appreciated as the same becomes better understood when considered in conjunction with the accompanying drawings, in which like reference characters designate the same or similar parts throughout the several views, and wherein.

Similar reference characters denote corresponding features consistently throughout the attached drawings.

DETAILED DESCRIPTION OF THE PREFERRED EMBODIMENTS

Figure 1:
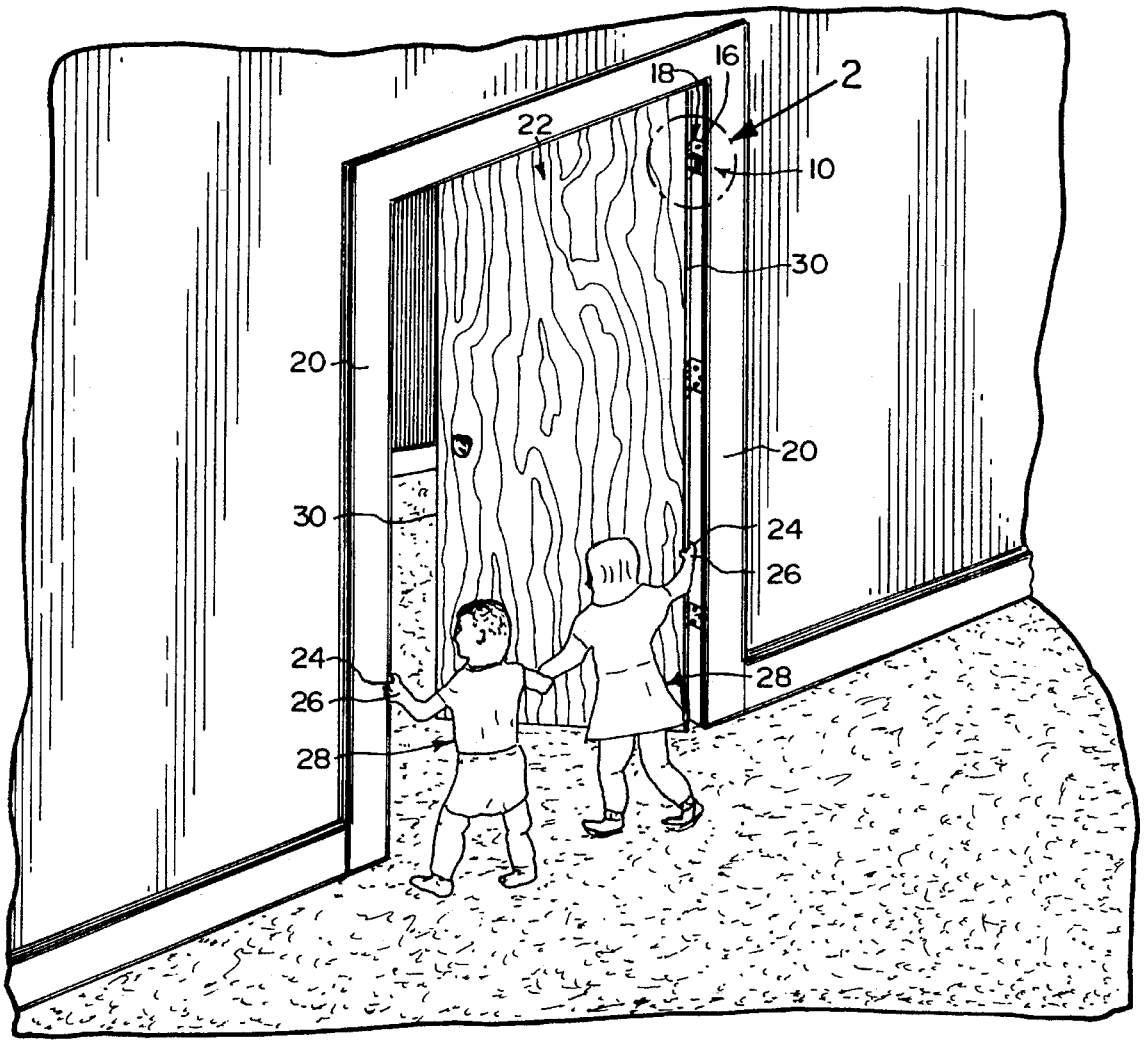
FIG. 1 is a perspective view showing the instant invention in place upon a doorjamb leaf of a door hinge preventing the door from closing on fingers of children.
Figure 2:
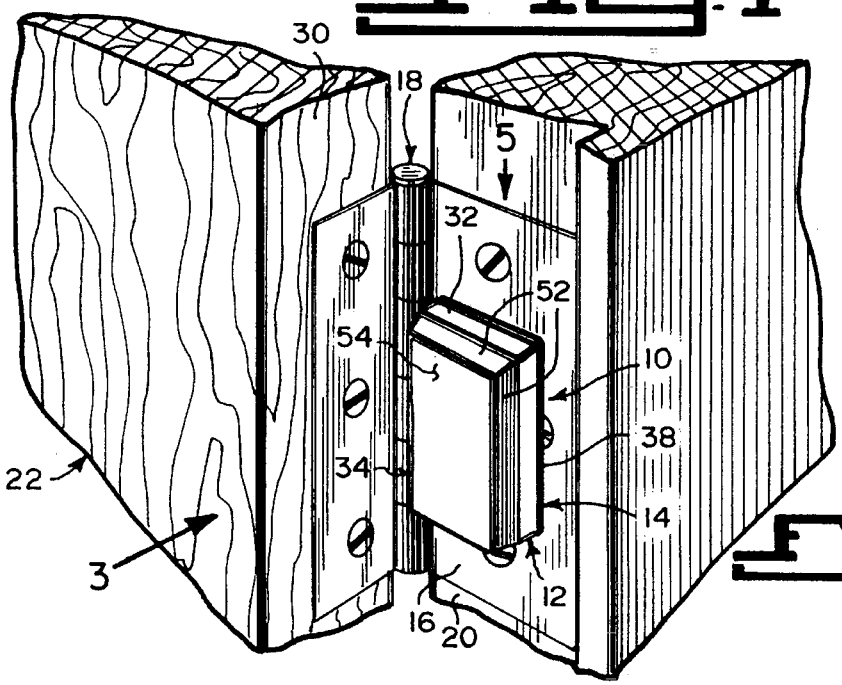
FIG. 2 is an enlarged perspective view as indicated by arrow 2 in FIG. 1, showing the instant invention on the doorjamb leaf of the door hinge.
Figure 3:
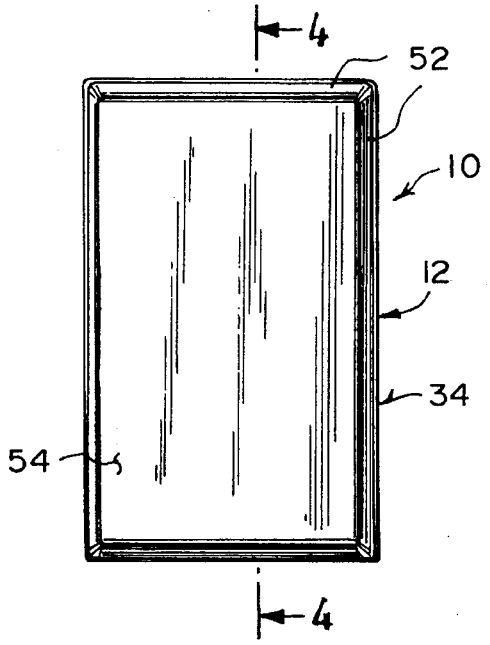
FIG. 3 is an elevational view of the instant invention per se taken in the direction of arrow 3 in FIG. 2.
Figure 4:
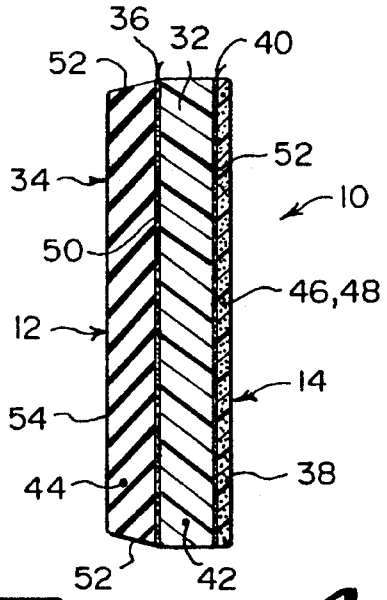
FIG. 4 is a cross sectional view taken along line 4—4 in FIG. 3, showing the various components thereof.
Figure 5:
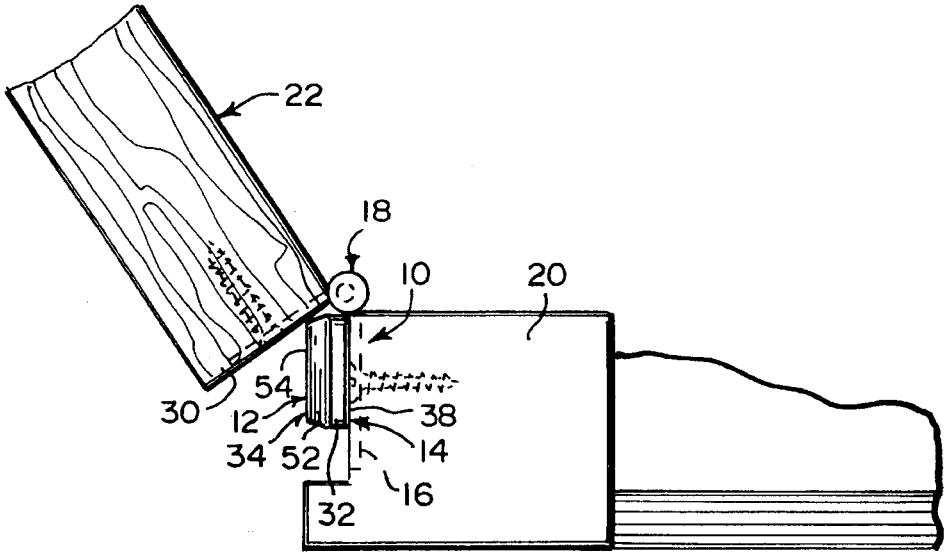
FIG. 5 is a top view taken generally in the direction of arrow 5 in FIG. 2.

Turning now descriptively to the drawings, in which similar reference characters denote similar elements throughout the several views, FIGS. 1 through 5 illustrate an improved doorstop 10, comprising a block member 12. A structure 14 is for securing in a removable manner the block member 12 against a leaf 16 of a hinge 18 on a doorjamb 20, so as to stop a door 22 from closing completely into the doorjamb 20 and preventing fingers 24 of a hand 26 of a person 28, such as a child getting caught and damaged between an edge 30 of the door 22 and the doorjamb 20.

The block member 12 consists of a base piece 32, a bumper portion 34 and an element 36, for attaching a bottom surface of the bumper portion 34 to a top surface of the base piece 32. The removable securing structure 14 includes a magnetic plate 38 and a component 40, for affixing a top surface of the magnetic plate 38 to a bottom surface of the base piece 32.

The base piece 32 is fabricated out of a bar of solid plastic material 42. The bumper portion 34 is fabricated out of a slab of hard rubber material 44. The magnetic plate 38 is fabricated out of a sheet of soft plastic material 46 impregnated with magnetized iron particles 48.

The attaching element 36 is a first layer of adhesive material 50 applied between the bottom surface of the bumper portion 34 and the top surface of the base piece 32. The affixing component 40 is a second layer of adhesive material 52 applied between the top surface of the magnetic plate 38 and the bottom surface of the base piece 32.

The base piece 32, the bumper portion 34 and the magnetic plate 38 are rectangular shaped. They are of the same general dimension in length and width, which is slightly smaller than the size of the leaf 16 of the hinge 18 on the doorjamb 20, so that said magnetic plate 38 will properly fit up against the leaf 16.

All of the edges 52 of the bumper portion 34 are beveled inwardly towards a top surface 54 thereof. When the magnetic plate 38 is placed up against the leaf 16 of the hinge 18 on the doorjamb 20, the edge 30 of the door 22 adjacent the doorjamb 20 will contact one of the long beveled edges 52 of the bumper portion 34 to stop the door 22 from closing.

OPERATION OF THE INVENTION

To use the improved doorstop 10, the following steps should be taken:

1. Open the door 22 all the way within the doorjamb 20 until the hinges 18 are completely exposed.
2. Place the magnetic plate 38 in a vertical position against the leaf 16 of the uppermost hinge 18 on the doorjamb 20.
3. Close the door 22 part way until the other leaf of the uppermost hinge 18 on the edge 30 of the door 22 engages with one of the long beveled edges 52 on the bumper portion 34.

To remove the improved doorstop 10, the steps should be taken:

1. Open the door 22 all the way within the doorjamb 20 until the other leaf of the uppermost hinge 18 on the edge 30 of the door 22 disengages with the long beveled edge 52 on the bumper portion 34.
2. Remove the magnetic plate 38 from the leaf 16 of the uppermost hinge 18 on the doorjamb 20.

3. Close the door 22 all the way until the door 22 is complete within the doorjamb 20.

LIST OF REFERENCE NUMBERS

10 improved doorstop
12 block member
14 removable securing structure
16 leaf of 18
18 hinge
20 doorjamb
22 door
24 finger on 26
26 hand of 28
28 person
30 edge of 22
32 base piece of 12
34 bumper portion of 12
36 attaching element between 32 and 34
38 magnetic plate of 14
40 affixing component between 32 and 38
42 bar of solid plastic material for 32
44 slab of hard rubber material for 34
46 sheet of soft plastic material for 38
48 magnetized iron particles in 46
50 first layer of adhesive material for 36
52 beveled edge of 34
54 top surface of 34

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. An improved doorstop for use with and in combination with a doorway, a doorjamb mounted in said doorway, a door, and hinge means including a first leaf mounted on an edge of said door and a second leaf mounted on said doorjamb for supporting said door in said doorjamb, said leaves joined by a hinge pin, comprising:

a) a block member having a base piece and a bumper portion mounted on one side of said base piece;

b) means for securing in a removable manner said block member against a one leaf of said hinge means to permit said door to close partially but remaining ajar sufficiently to prevent the fingers of a hand of a person getting caught and damaged between an edge of the door and the doorjamb; and c) said securing means comprising a magnetic plate affixed to the opposite side of said base piece.

2. An improved doorstop as recited in claim 1, wherein said base piece is fabricated out of a bar of solid plastic material.

3. An improved doorstop as recited in claim 1, wherein said bumper portion is fabricated out of a slab of hard rubber material.

4. An improved doorstop as recited in claim 1, wherein said magnetic plate is fabricated out of a sheet of soft plastic material impregnated with magnetized iron particles.

5. An improved doorstop as recited in claim 1, wherein said base piece, said bumper portion and said magnetic plate are rectangular shaped and being of the same general dimension in length and width which is slightly smaller than the size of the leaf of the hinge mounted thereon, so that said magnetic plate will properly fit up against the leaf.

6. An improved doorstop as recited in claim 5, wherein all of the edges of said bumper portion are beveled inwardly towards a top surface thereof, so that when said magnetic plate is placed up against the leaf of the hinge on the doorjamb, the edge of the door adjacent the doorjamb will contact one of said long beveled edges of said bumper portion to stop the door from closing.

* * * * *